US006742311B2

(12) United States Patent
Fortier

(10) Patent No.: US 6,742,311 B2
(45) Date of Patent: Jun. 1, 2004

(54) MODULAR TRANSPORTABLE FLOOR DECKING SYSTEM

(75) Inventor: Guy Fortier, Longueuil (CA)

(73) Assignee: Expo Design International, Longueuil (CA)

( * ) Notice: Subject to any disclaimer, the term of this patent is extended or adjusted under 35 U.S.C. 154(b) by 73 days.

(21) Appl. No.: 10/244,462

(22) Filed: Sep. 17, 2002

(65) Prior Publication Data

US 2004/0050010 A1 Mar. 18, 2004

(51) Int. Cl.[7] ..... E04B 1/26

(52) U.S. Cl. ..... 52/185; 52/183; 52/650.3; 52/731.3

(58) Field of Search ..... 52/184, 185, 182, 52/183, 650.3, 655.1, 653.2, 731.4, 731.5, 732.3, 736.2; 403/217, 218, 169, 170, 171, 172

(56) References Cited

U.S. PATENT DOCUMENTS 3,977,147 A * 8/1976 Fletcher et al. ..... 52/648.1
4,544,300 A * 10/1985 Lew et al. ..... 403/170
4,685,258 A * 8/1987 Av-Zuk ..... 52/126.6
4,747,243 A * 5/1988 Anstead ..... 52/184
5,116,299 A * 5/1992 Kvols ..... 403/187
5,265,972 A * 11/1993 Bahr ..... 403/252
5,271,204 A * 12/1993 Wolf et al. ..... 52/730.1
5,451,115 A * 9/1995 Sayres ..... 403/171
5,625,987 A * 5/1997 Zamerovsky ..... 52/263
5,727,358 A * 3/1998 Hayashi et al. ..... 52/745.2
5,921,049 A * 7/1999 Sugiyama ..... 52/653.1
6,435,755 B1 * 8/2002 Nagai et al. ..... 403/191
6,568,145 B2 * 5/2003 Bartel ..... 52/741.2

* cited by examiner

*Primary Examiner*—Carl D. Friedman
*Assistant Examiner*—Basil Katcheves
(74) *Attorney, Agent, or Firm*—Ogilvy Renault; Guy Houle

(57) ABSTRACT

A modular portable floor decking system for constructing a temporary or a permanent flooring structure is described. The system comprises a plurality of extruded metal hollow support posts and a plurality of beams interconnectable with the posts to form a support frame. Decking boards are securable across the beams. The support posts each have flat outer surfaces and two or more longitudinal connecting channels each disposed internally of an associated one of the flat outer surfaces. The channels have a central narrow slot extending along the respective flat outer surfaces. The beams have opposed flat connecting end walls and a metal clamping shoe is connected to the end walls of the beams by fasteners whereby to displace the shoe away from the flat surfaces to slide the shoe in a respective connecting channel of the posts as the beam is lowered between two posts. The shoes are clamped in the channels by the use of fasteners which are accessible behind the flat connecting end walls of the beams whereby to clamp the beam between a pair of posts.

17 Claims, 6 Drawing Sheets

MODULAR TRANSPORTABLE FLOOR DECKING SYSTEM

TECHNICAL FIELD

The present invention relates to a modular transportable floor decking system for constructing a temporary or a permanent flooring structure.

BACKGROUND ART

Modular portable floor-decking systems are used for constructing elevated platforms at different heights and providing ramps for access thereto. An example of such systems is described in U.S. Pat. Nos. 5,720,135 and 5,848,501. However, these systems have been conceived for very large structures for supporting heavy loads such as vehicles. There is however a need to provide a portable floor decking system which is structurally sound, which is easy to transport and which can be assembled and disassembled quickly by only a few people. There is also a need to provide such a system which does not require any heavy machinery for its loading and unloading from a transport vehicle. There is also a need to provide such a system which is aesthetically pleasing and versatile to construct floor decking systems of different shapes using the same basic structural components.

SUMMARY OF INVENTION

It is therefore a feature of the present invention to provide a modular portable floor decking system for constructing a temporary or permanent flooring structure which provides the above needs and overcomes the disadvantages of the above-mentioned prior art.

According to a broad aspect, the present invention provides a modular portable floor decking system for constructing a temporary or a permanent flooring structure.

The system comprises a plurality of extruded metal hollow support posts and a plurality of beams interconnectable with the posts to form a support frame. Decking members are securable across the beams. The support posts each have flat outer surfaces. Two or more longitudinal connecting channels are disposed internally of two or more of the flat outer surfaces of the posts. The two or more longitudinal connecting channels each have a central narrow slot extending along their respective flat outer surfaces. The beams each have opposed flat connecting end walls. A metal clamping shoe is dimensioned for close sliding fit in the connecting channels and is adjustably connected to the connecting end walls by two or more spaced fasteners extending through the bores formed in the flat connecting end walls whereby to retain the clamping shoe spaced adjacent an outer flat surface of the connecting end wall. The fasteners each have a threaded end engaged in threaded bores of the clamping shoe and a tool engaging head accessible adjacent an inner surface of the connecting end wall. The beams are connected to the hollow support posts by spacing the shoes from the outer surface of the flat connecting end wall and sliding the shoe, connected to said end surface of its beam, in one of the channels with the fasteners extending through the central narrow slot and then the fasteners are tightened when the beam is at a desired position with respect to the support posts whereby to clamp the outer flat surface of the connecting end wall of the beam on the flat outer surface of the support posts.

According to a further broad aspect of the present invention there is further provided stopper means securable in the channels at a predetermined position along the length of the channel to provide an abutment for the metal clamping shoe when slid in the channel to position the beams at predetermined heights between the posts.

BRIEF DESCRIPTION OF DRAWINGS

The preferred embodiments of the present invention will now be described with reference to the accompanying drawings in which.

DESCRIPTION OF PREFERRED EMBODIMENTS

Figure 1A:
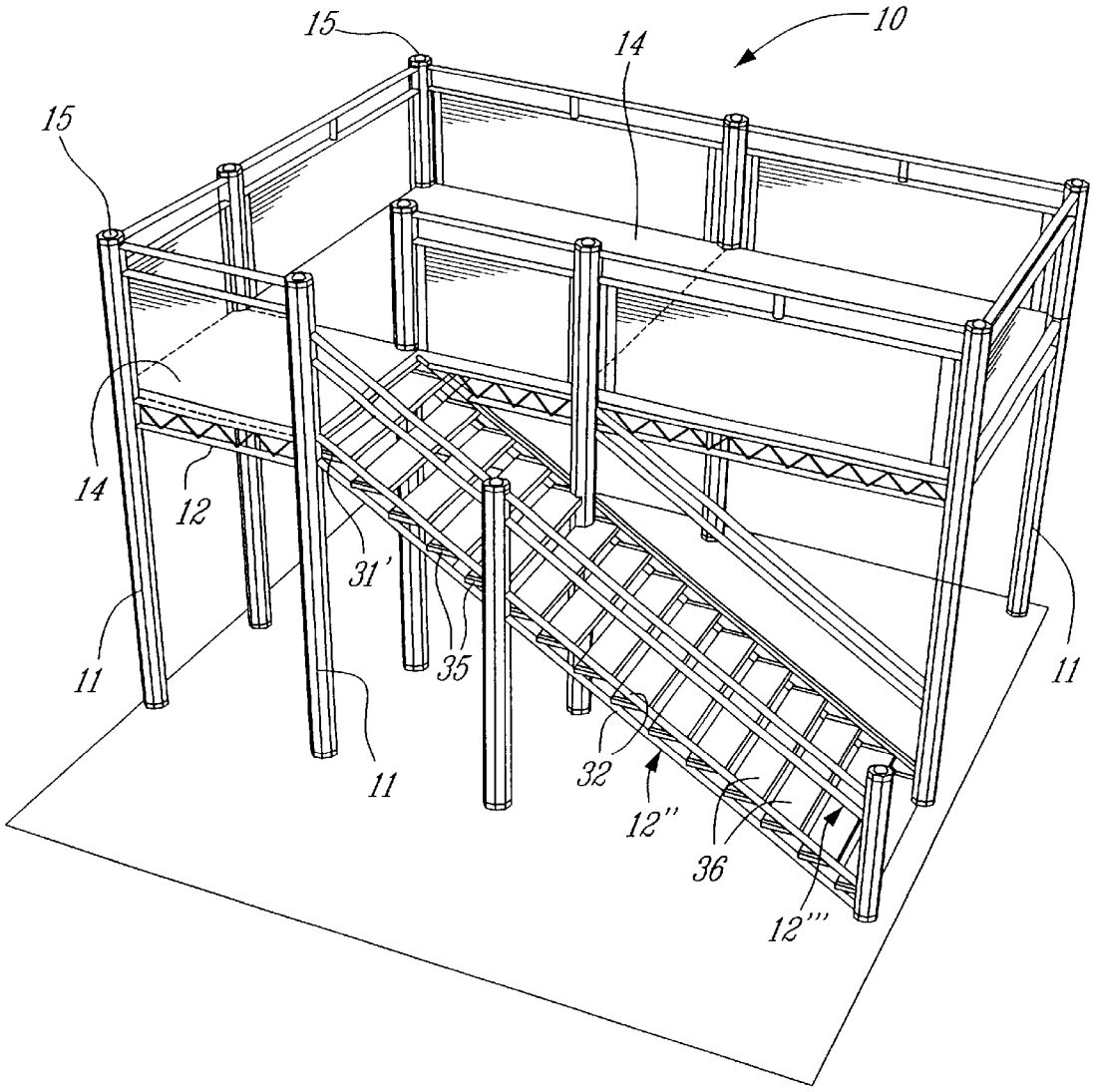
FIG. 1A is a perspective view of a modular portable floor decking system constructed in accordance with the present invention.
Figure 1B:
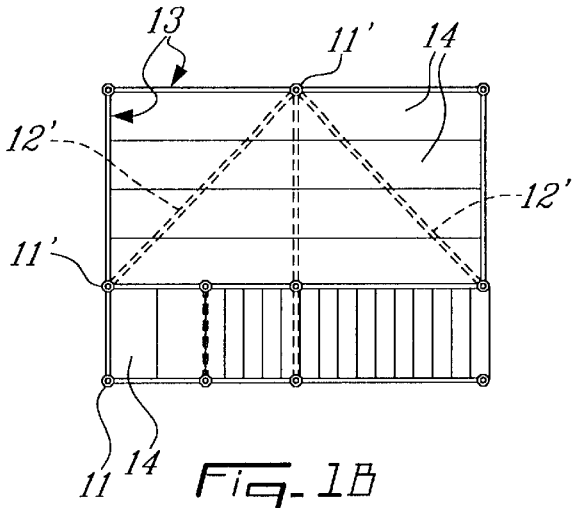
FIG. 1B is a top view of FIG. 1A illustrating the support frame structure constructed in accordance with the present invention.

Referring to the drawings and more particularly to FIGS. 1A and 1B there is shown generally at 10 a modular portable floor decking system constructed in accordance with the present invention for the construction of temporary or permanent flooring structures. The system essentially comprises a plurality of extruded metal hollow support posts 11 and a plurality of beams 12 interconnected to and between the posts 11 whereby to form a support frame 13 which is better illustrated in the simplified top view in FIG. 1B. As hereinshown the beams 12 are connected to the posts 11 at right angle whereby to form a rectangular structure. The beams 12' are also connected diagonally between posts such as posts 11' to span under decking panels 14 to provide support for the flooring structure and to provide structural integrity of the support frame 13.

Figure 2:
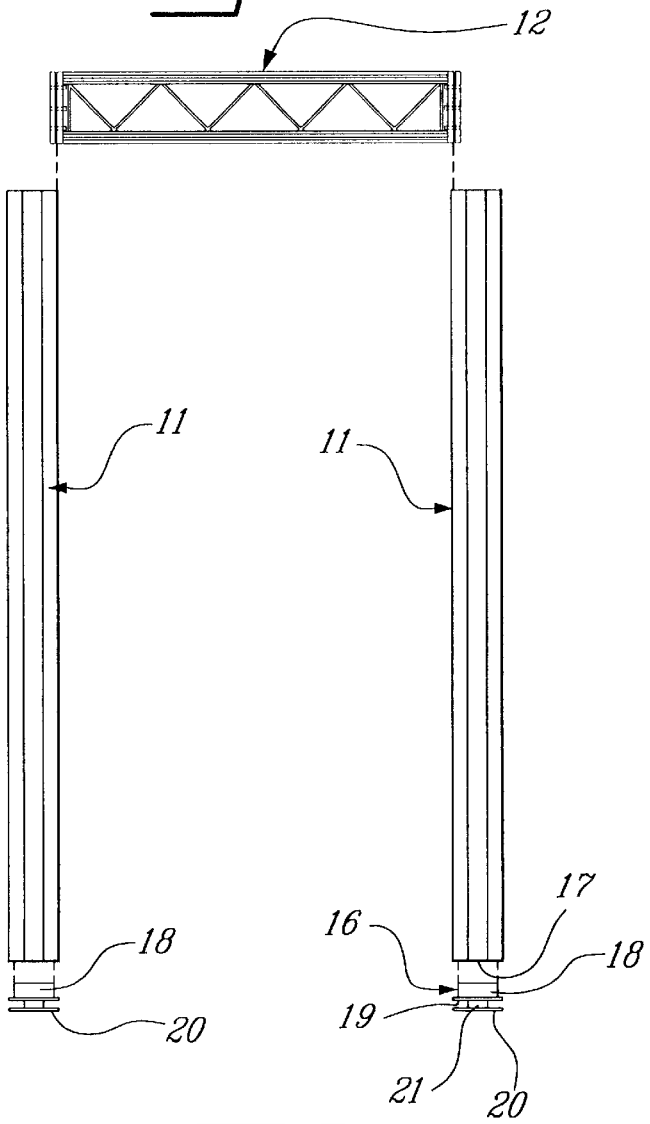
FIG. 2 is an exploded view showing how the beams are connected to the support posts and illustrating the location of the adjustable foot which is inserted in the lower end of the posts.

The posts 11 are further provided with end caps 15 to conceal the open end of the posts which are extruded aluminum posts as will be described in more detail hereinbelow. As shown in FIG. 2 each of the posts is also provided with an adjustable foot member 16 which is fitted in the lower open end 17 of the posts. The adjustable foot members 16 are provided with a cup portion 18 configured to fit within the extrusion of the posts 11 and a bottom wall 19. A foot plate 20 is provided with a threaded rod 21 whereby to provide a height adjustment to the posts once the structure has been erected whereby to level the decks or floors.

Figure 3:
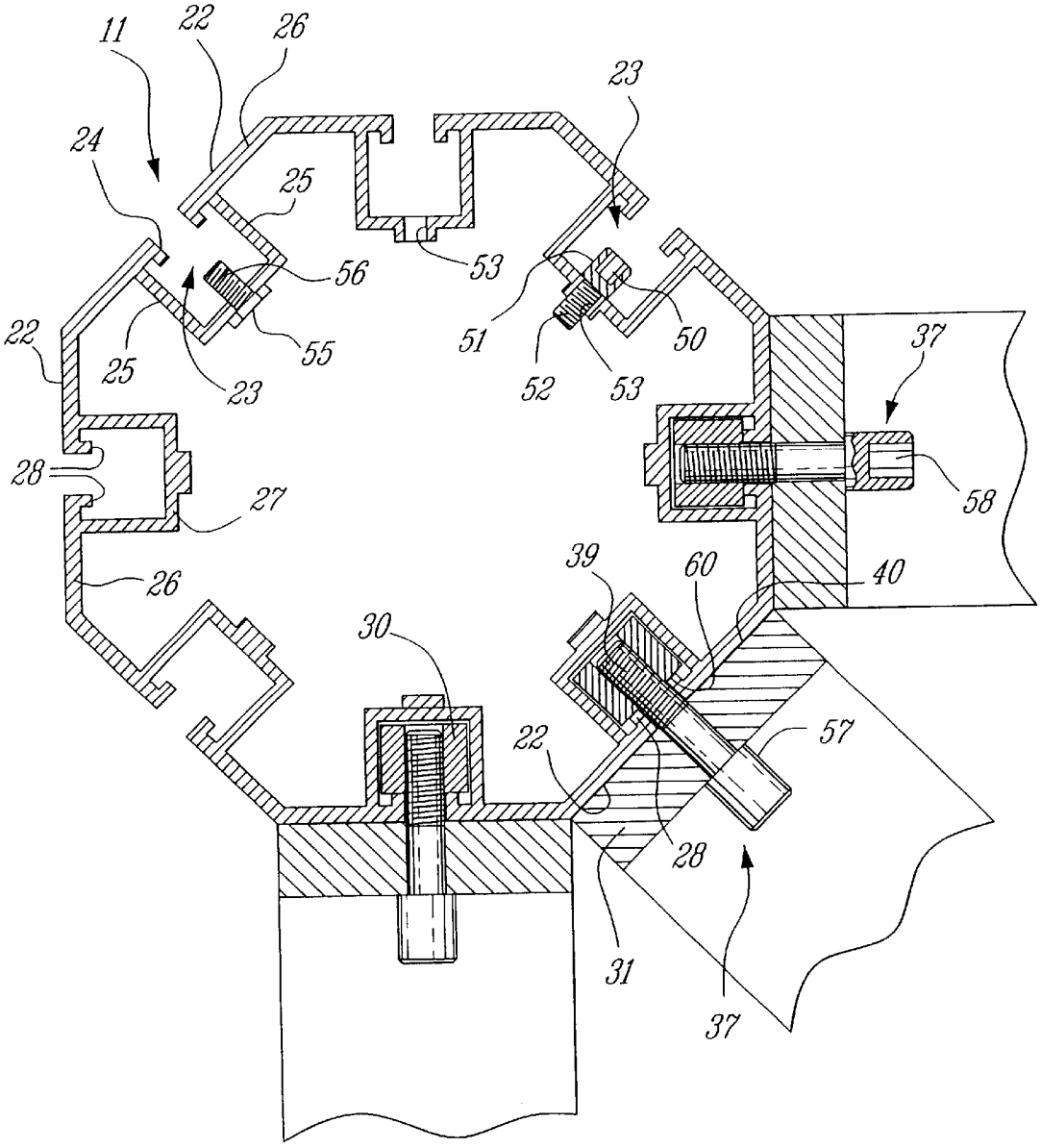
FIG. 3 is a section view illustrating the construction of the posts and how the beams are interconnected thereto.
Figure 4A:
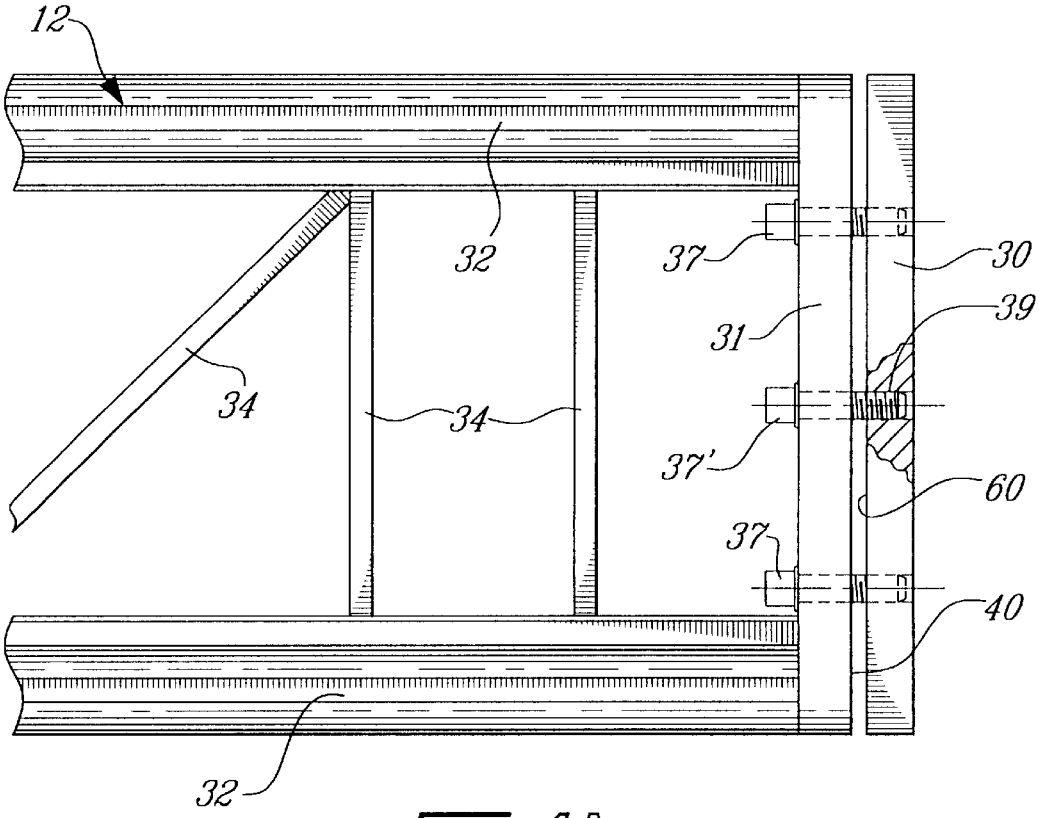
FIG. 4A is a fragmented end view illustrating the construction of the beams and the clamping shoes secured to the end walls of the beam.
Figure 4B:
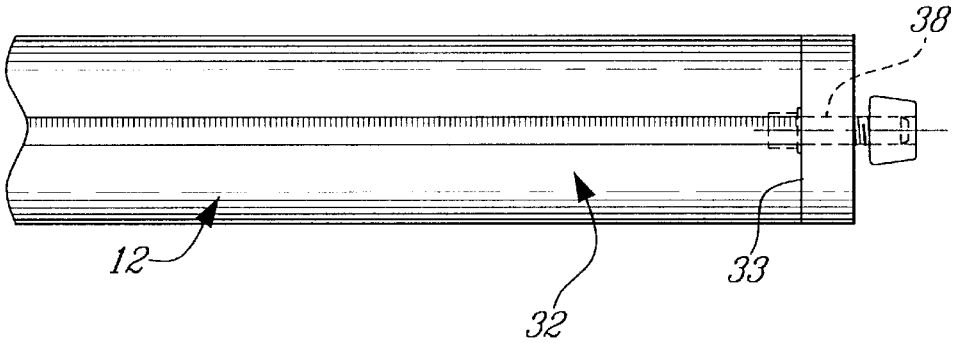
FIG. 4B is a top view of FIG. 4A.

With reference now to FIGS. 2 and 3 there will be described the construction of the hollow posts 11. As previously described these hollow metal posts are formed by aluminum extrusions and each post 11 has a two or more, herein eight, flat outer surfaces 22 as the post herein illustrated is of hexagonal cross-section. It is also conceivable that the post could be of a square cross-section or other suitable cross-sections achieving the object of the present invention. Each post is also provided with two or more, herein eight, longitudinal connecting channels 23 each disposed internally of an associated one of the flat outer surfaces 22. Each longitudinal connecting channel 23 has a central narrow slot 24 extending along its respective outer surface 22. These slots 24 are centrally disposed along these outer surfaces 22. There may also be longitudinal channels in only selected ones of these outer surfaces 22.

The connecting channels 23 are of rectangular cross-section and define a pair of opposed sidewalls 25 formed integral with the front wall 26, and an inner wall 27. A pair of flanges 28 extend a short distance inwardly of the channel 23 and are each disposed on an opposed side of the central narrow slot 24 to strengthen the front wall 26 and provide longitudinal abutments for the metal shoes 30 which clamp the beams to the posts which will now be described.

As can be seen in FIGS. 2, 3, 4A and 4B each of the beams 12 are comprised by a pair of structural longitudinal members 32 which are also aluminum extrusions which are secured spaced apart in parallel relationship between opposed flat connecting end walls 31. The end walls 31 are metal plates and the structural longitudinal members 32 are welded thereto by welds 33 formed along their end edge. A reinforcing lattice rod structure 34 provides added strength to the beam 12. As shown in FIG. 1A the beams 12 can also be provided as stair support side beams 12" and wherein the end walls 31' are welded at an angle thereto. Brackets 35 may also be connected between the structural longitudinal members 32 whereby to receive stair boards 36 between a pair of these beams 12". The stair boards 36 are connected to the brackets 35 by suitable fastening means not shown. Another beam 12'" is constructed similar to the stair support beam 12" but without brackets whereby to provide a stair handrail.

Referring again to FIGS. 4A and 4B, the metal clamping shoe 30 is a steel shoe of substantially tapered square cross-section and is of substantially the same length as the end wall 31. This shoe is dimensioned for close sliding fit in the connecting channels 23 of the posts as clearly illustrated in FIG. 3. The shoes 30 are adjustably connected to the connecting end walls 31 by two or more spaced fasteners, herein three fasteners 37 which are spaced apart and extend through bores 38 formed in the flat connecting end walls 31 and are threaded into threaded bores 39 formed in the shoe 30 whereby to retain the clamping shoes adjustably spaced adjacent the outer flat surface 40 of the connecting end wall 31. By unthreading the screws 37 the shoe 30 can be displaced outwardly whereby to permit the shoe to be slid into a channel of a post from an end of the post with the fasteners 37 extending through the central narrow slot 24 as the beam is lowered between posts, as illustrated in FIG. 3. As the opposed ends of a beam are slid through the longitudinal connecting channels 23 of two posts 11, the beam is positioned at a desired height and the screws are tightened. Preferably the beam is lowered down slowly and as horizontally as possible between the posts to assure ease of insertion. Once the beam is at a desired position it is then connected to the post by tightening the fasteners 37. Preferably, the central fastener 37' is fasten first and then the other two fasteners thereafter. By doing so the outer flat surface 40 of the connecting end wall 31 of the beam is clamped firmly against the outer flat surface 22 of the support posts 11.

Figure 5:
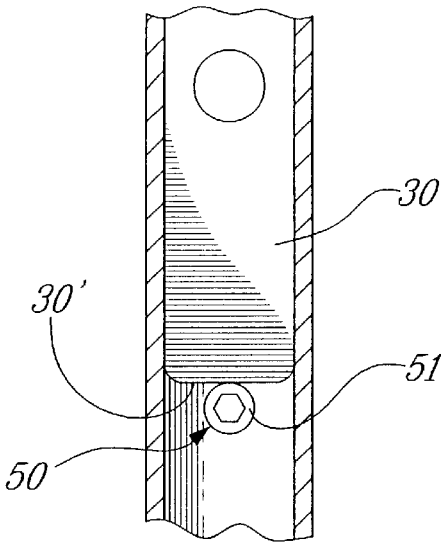
FIG. 5 is a fragmented side view showing the clamping shoe in abutment with a stopper secured to the inner wall of a longitudinal connecting channel.

The modular portable floor-decking system of the present invention may also be provided as a kit wherein the floor-decking structure is assembled and disassembled to form temporary flooring structures. Accordingly, the component parts of the system can be identified for the erection of specific decking structures. For such use it is preferable to provide stopper means 50 in the form of connectors secured at predetermined locations along some or all of the channels of the posts. The stopper means 50 may be comprised by a nut 51 having a circular outer circumference which is secured to a fastener 52 which extends in a through bore or threaded bore 53. The nut is threaded on the fastener end which projects in the cavity 54 with the nut disposed inside the channel 23 at a specific location whereby to provide an abutment. As shown in FIG. 5, the lower end wall 30' of the shoe 30 sits on the nut so that the beam can be positioned between a pair of posts at a desired position sitting on the stoppers 50.

As shown in FIG. 3 the stopper 50 may also be comprised by a screw bolt 55 having its threaded shaft 56 extending into the channel with the threaded shaft supporting the shoe 30.

As shown in FIG. 3 the heads 57 of the fasteners 37 are provided with a recessed hexagonal bore 58 whereby to receive an Allen key type tightening tool, not shown, but obvious to a person skilled in the art. This provides better torquing for the fasteners whereby to solidly clamp the surfaces 22 and 40 together with the flat clamping wall 60 of the shoe tensioned against the flanges 28 on opposed sides of the narrow central slot 24.

Figure 6:
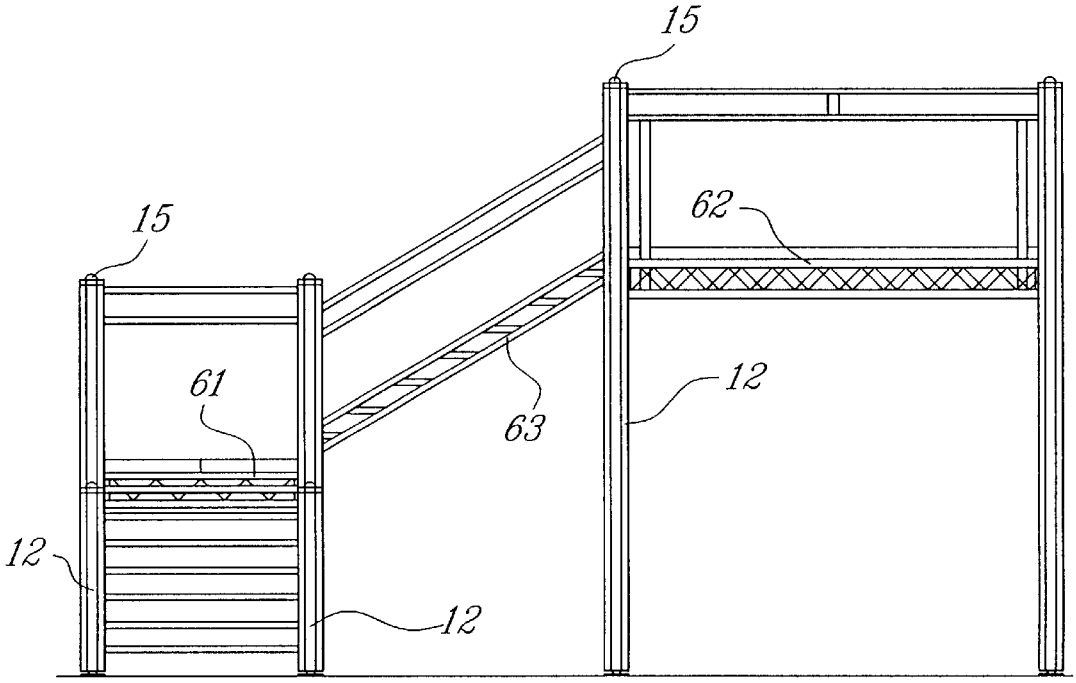
FIG. 6 is a side view showing a further modular portable floor-decking structure constructed in accordance with the present invention.

FIG. 6 shows another configuration of a modular portable floor decking system constructed in accordance with the present invention and wherein platforms of different heights herein platforms 61 and 62 erected spaced from one another and interconnected by a staircase 63 formed as previously described. As hereinshown a diagonal beam 12' also spans the large decking floor structure 62 for the reasons as previously described.

Figure 7:
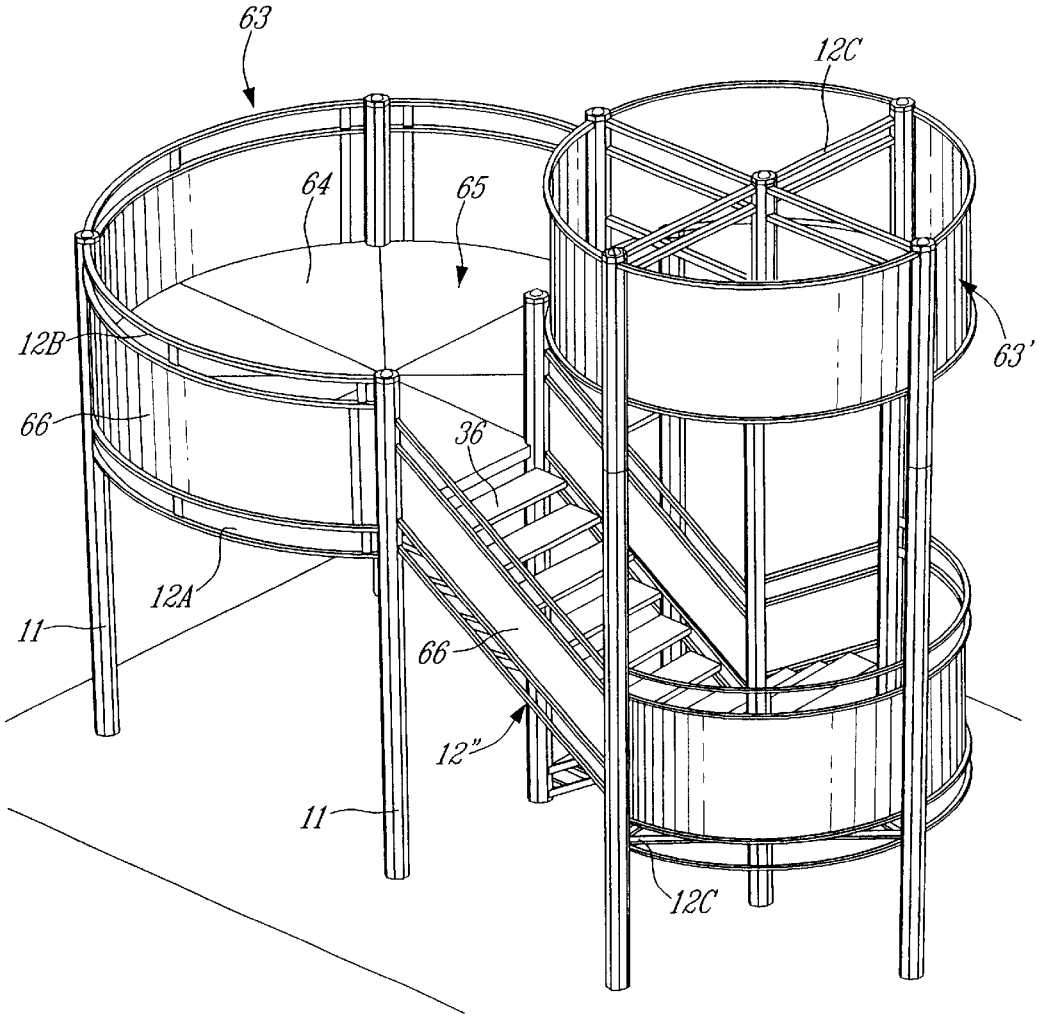
FIG. 7 is a perspective view showing a still further modular portable floor decking structure but wherein the structure has circular platforms and is constructed in accordance with the present invention.

FIG. 7 shows a still further configuration of a modular portable floor decking system constructed in accordance with the present invention and wherein some of the beams such as beam 12A are curved beams whereby to form curved flooring structure 63. As hereinshown some of the structures, such as structure 63' is purely for aesthetic or decorative purpose. Floor boards 64 of triangular outline are also provided to form the flooring 65. Side panels 66 are also removably connected between the beams 12A and the rails 12B to provide protection and/or to provide advertisements. These side panels are also connected between the beams of the stairwells. Cross beams 12C are also connected under flooring 65 to provide added strength to the structure.

It is within the ambit of the present invention to cover any obvious modifications of the preferred embodiment described herein providing such modifications fall within the scope of the appended claims.

What is claimed is:

1. A modular portable floor decking system for constructing a temporary or permanent flooring structure, said system comprising a plurality of extruded metal hollow support posts and a plurality of beams interconnectable with said posts to form a support frame, decking members securable across said beams; said support posts each having flat outer surfaces, two or more longitudinal connecting channels each disposed internally of an associated one of said flat outer surfaces of each of said posts, said two or more longitudinal connecting channels each having a central narrow slot extending along their respective flat outer surfaces; said beams each having opposed flat connecting end walls, a metal clamping shoe dimensioned for close sliding fit in said connecting channels is adjustably connected to said connecting end walls by two or more spaced fasteners extending through bores formed in said flat connecting end walls to retain said clamping shoe spaced adjacent an outer flat surface of said connecting end wall, said fasteners each having a threaded end engaged in threaded bores of said clamping shoe, and a tool engaging head accessible adjacent an inner surface of said connecting end wall; said beams being connected to said hollow support posts by spacing said shoe from said outer surface of said flat connecting end wall and sliding said shoe in one of said channels with said fasteners extending through said central narrow slot and tightening said fasteners when said beam is at a desired position with respect to said support post whereby to clamp said outer flat surface of said connecting end wall of said beam on said flat outer surface of said support post.

2. A modular portable floor decking system as claimed in claim 1 wherein there is further provided stopper means securable in said channels at predetermined positions along the length of said channel to provide an abutment for said metal clamping shoe when slid in said channel to position said beams at predetermined heights between said posts.

3. A modular portable floor decking system as claimed in claim 1 wherein said hollow support posts are of hexagonal cross-section defining eight flat outer surfaces of equal width, therebeing one of said longitudinal connecting channel associated with each said outer surfaces.

4. A modular portable floor decking system as claimed in claim 3 wherein said beams are comprised by a pair of structural longitudinal members secured spaced apart in parallel relationship between opposed flat connecting end walls.

5. A modular portable floor decking system as claimed in claim 4 wherein said connecting end walls are secured to said structural longitudinal members at a common angle and extend parallel to one another, said beam constituting a stair support beam, said decking boards being stairboards secured between a pair of said stair support beams to form a stairwell.

6. A modular portable floor decking system as claimed in claim 5 wherein said stair support beam further constitutes a stair handrail.

7. A modular portable floor decking system as claimed in claim 4 wherein a reinforcing lattice rod structure is secured between said pair of structural longitudinal members.

8. A modular portable floor decking system as claimed in claim 4 wherein said structural longitudinal members are curved members whereby to form curved flooring structures.

9. A modular portable floor decking system as claimed in claim 5 wherein said decking boards are panels of rectangular or triangular outline, said flooring structure having two or more horizontal floors disposed at different heights and accessible by said stairwells.

10. A modular portable floor decking system as claimed in claim 1 wherein said beam is also securable between said posts spaced a predetermined distance above said beams supporting said decking boards whereby to constitute rails.

11. A modular portable floor decking system as claimed in claim 10 wherein side panels are secured between said beams supporting said decking boards and said rails.

12. A modular portable floor decking system as claimed in claim 1 wherein there is further provided an end cap removably mounted at a top end of said support post to cover an open end of said hollow extrusion.

13. A modular portable floor decking system as claimed in claim 1 wherein adjustable foot member is secured to a lower end of said hollow support posts whereby to level said structure.

14. A modular portable floor decking system as claimed in claim 3 wherein said beams are also connected to said posts at angles to other of said beams connected to said posts to span diagonally under said decking boards to provide support of said decking members and structural integrity of said support frame.

15. A modular portable floor decking system as claimed in claim 2 wherein said stopper means are fasteners secured to an inner wall of said channels at said predetermined locations and extending inside said channel to constitute said abutment.

16. A modular portable floor decking system as claimed in claim 15 wherein a nut of circular circumference is secured to each said fasteners and disposed in said channels.

17. A modular portable floor decking system as claimed in claim 1 wherein said floor decking system is a kit system installable on site and transportable in a disassembled state.

* * * * *